United States Patent [19]

Lotrous et al.

[11] Patent Number: 4,466,540

[45] Date of Patent: Aug. 21, 1984

[54] MERCHANDIZING PACKAGE

[75] Inventors: Robert Lotrous, Chailly-en-Gatinais; Paul Darbois, Poras, both of France

[73] Assignee: Plastiques Industriels Thecla, Giromagny, France

[21] Appl. No.: 507,482

[22] Filed: Jun. 24, 1983

[30] Foreign Application Priority Data

Jun. 25, 1982 [FR] France ..... 82 11138

[51] Int. Cl.[3] ..... B65D 85/672; A45C 13/18; E05B 47/08

[52] U.S. Cl. ..... 206/387; 206/1.5; 206/807; 70/276; 70/DIG. 55

[58] Field of Search ..... 206/387, 1.5, 807; 70/276, DIG. 54, DIG. 55

[56] References Cited

U.S. PATENT DOCUMENTS

| | | | |
|---|---|---|---|
| 1,933,126 | 10/1933 | Slattery | 70/276 |
| 3,828,922 | 8/1974 | Holkestad | 206/387 |
| 4,285,429 | 8/1981 | MacTarish | 206/1.5 |
| 4,324,121 | 4/1982 | Richter | 70/DIG. 55 |
| 4,356,918 | 11/1982 | Kahle et al. | 206/387 |

FOREIGN PATENT DOCUMENTS

| | | |
|---|---|---|
| 310031 | 9/1973 | Austria . |
| 2426300 | 12/1975 | Fed. Rep. of Germany . |
| 1398398 | 3/1965 | France . |
| 821384 | 4/1982 | Monaco . |

*Primary Examiner*—William T. Dixson, Jr.
*Assistant Examiner*—Brenda J. Ehrhardt
*Attorney, Agent, or Firm*—Charles E. Brown

[57] ABSTRACT

A package comprises a cover closing an article housing formed in a baseplate. A contiguous compartment closed by a plate contains a spring assembly comprising two arc members joined at their ends and bearing on abutment members. A profiled rod inserted through a complementarily profiled opening pushes on thrust member against the abutment of the ends of the spring assembly on the abutment members so as to bring about, by symmetrical reaction, retraction of the bar supporting the bolt members. However, if a fly-weight has not previously been retracted by a magnetic field a projection engages in a groove in the fly-weight to lock the lock. The consecutive action of the magnetic field and the pressure on thrust member are applied by a key device retained at the checkout of the self-service store. The invention has one particular application in the merchandizing of prerecorded magnetic tape cassettes.

10 Claims, 6 Drawing Figures

MERCHANDIZING PACKAGE

BACKGROUND OF THE INVENTION

1. Field of the invention

The invention concerns a re-usable theft-resistant package for the self-service merchandizing of goods, comprising a cover retained by a lock operated mechanically and electromagnetically by a key device.

2. Description of the prior art

The invention has been conceived to take into account special features of self-service retailing, as practised notably in supermarkets and hypermarkets, where goods and merchandize are offered for sale to customers in different departments, the customers themselves selecting the goods and merchandize they wish to purchase and completing the purchase at a checkout where payment is made. This merchandizing method offers the advantage of a substantial increase in the volume of sales per employee and of giving the customer the impression of freedom of choice. On the other hand, its major disadvantage is that it facilitates theft, especially of small articles which can be easily hidden when passing through the checkouts.

To reduce this type of theft, sometimes referred to as "unknown mark-down", it is common practice to offer small articles for sale in packaging consisting of a backing sheet of cardboard or similar material covered with a transparent plastics film shaped to provide a housing for the article. This type of package is often referred to as a "blister pack". In practice, the backing sheet is substantially rectangular, with suspension means in the form of an eyelet or hook formed in an extension on one of the shorter sides of the rectangle, this rectangle often having dimensions larger than those of an ordinary garment pocket.

These types of merchandizing package are non-re-usable, however. They must be easily destroyed to enable purchasers to gain access to the articles without using special tools. When the articles enclosed are of intrinsically high value or constitute a special attraction for customers in reduced circumstances, these non-re-usable packages do not offer the store sufficient security, as they can be opened to take out the articles contained in them and then thrown away and the article hidden, at a sufficient distance from the checkouts for the attempted theft to go unseen. Thus it is very rare for watches or prerecorded magnetic tape cassettes to be offered for sale on a self-service basis, at least in non-specialist stores where surveillance is less active.

There have been produced and used packages of the same general form as the non-re-usable packages, but re-usable in that they have a cover which is retained by a lock which is opened using a key device at the checkout. In principle, this arrangement represents a significant improvement in security against the type of theft just described. It will be clear that the re-usable device may be more expensive than the disposable packaging.

However, the degree of security obtained is directly proportional to the resistance of the lock. A conventional key-operated lock would be of no utility since the need for quick opening at any checkout would require that all locks correspond to the same key and that the key be produced in large numbers. It would not be possible to prevent the illicit copying of keys.

In one known arrangement, the lock consists of an electromagnetic device similar to an electric striker box. The key device at the checkouts comprises an electrical power source to operate the lock. To prevent fraudulent opening, the parts which connect the key device to the lock of the package are of unusual shape, in particular to render access to the terminals on the package difficult. Also, the male part of the connector carried by the key device is adapted to push back an auxiliary mechanical lock which prevents operation of the electromagnetic lock.

This arrangement, conceived to make fraudulent opening highly difficult, has proven in use to be susceptible to forcing. The force which the moving armature of an electric striker box can withstand is extremely limited, which results in the need for gearing down and renders the closure highly sensitive to impact. Further, the auxiliary mechanical lock may be operated from the outside, by inserting a pointed instrument into the housing formed in the package to permit entry of the male part of the connector carried by the key device. As a result, the package may be opened.

The object of the invention is a theft-resistant package combining electromagnetic and mechanical opening and which does not features these disadvantages.

SUMMARY OF THE INVENTION

The invention consists in a re-usable theft-resistant package suitable for self-service merchandizing of goods, comprising a cover, a lock adapted to be operated mechanically and electromagnetically and to retain said cover, a bolt member incorporated in said lock, a profiled opening in said package adapted to admit a complementarily profiled rod adapted to push back said bolt member and forming part of a corresponding key device, a fly-weight of ferromagnetic material disposed to resist selectively pushing back of said bolt member and adapted to permit pushing back of said bolt member by retracting in response to a magnetic field, and a return spring adapted to resist retraction of said fly-weight, the arrangement being such that said fly-weight is retracted by a magnetic field produced by said key device to permit pushing back of said bolt member so as to unlock the package.

It will be realized that the mechanical action of the profiled rod carried by the key device authorizes the operation of a lock featuring relatively long travel and virtually insensitive to impact. Also, the retraction of the ferromagnetic fly-weight requires the application of a magnetic field of the appropriate intensity and direction, presupposing the use of a non-standard apparatus.

The bolt member preferably comprises a spring assembly formed by two arc members of oppositely direct concavity, joined at their ends and bearing on abutment members integral with the package. The thrust of the profiled rod is applied to a thrust member disposed at the top of a first arc member, on the convex side, while a bolt support crossmember is fixed to the top of the second arc member. Thrust on the thrust member, countered by abutment of the ends on the abutment members, reduces the curvature of the first arc member and conjointly increases the length of the chord; as the latter is common to both arc members, the curvature of the second is reduced, pulling back the bolt support crossmember.

The fly-weight is preferably in the form of a body of revolution and disposed inside the spring assembly so as to retract laterally along its axis of revolution under the effect of the magnetic field and so that, when unoperated, it prevents deformation of the spring assembly by action on the thrust member. A projection at the top of the first arc member, on the concave side, is adapted to engage in a groove in the fly-weight as soon as the thrust member is acted on. Thus the fly-weight cannot retract in cases where it has not been retracted before the thrust member is pressed. The abutment of the ends of the spring assembly on the abutment members is positive only when a thrust is exerted on the thrust member, so that it is possible to close the cover, by pushing back the bolt support bar, without the use of a key device.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 2:
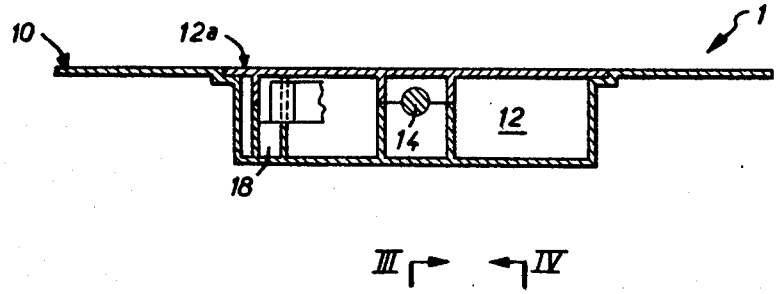
FIG. 2 is a cross-section on the plane II—II in FIG. 1.
Figure 1:
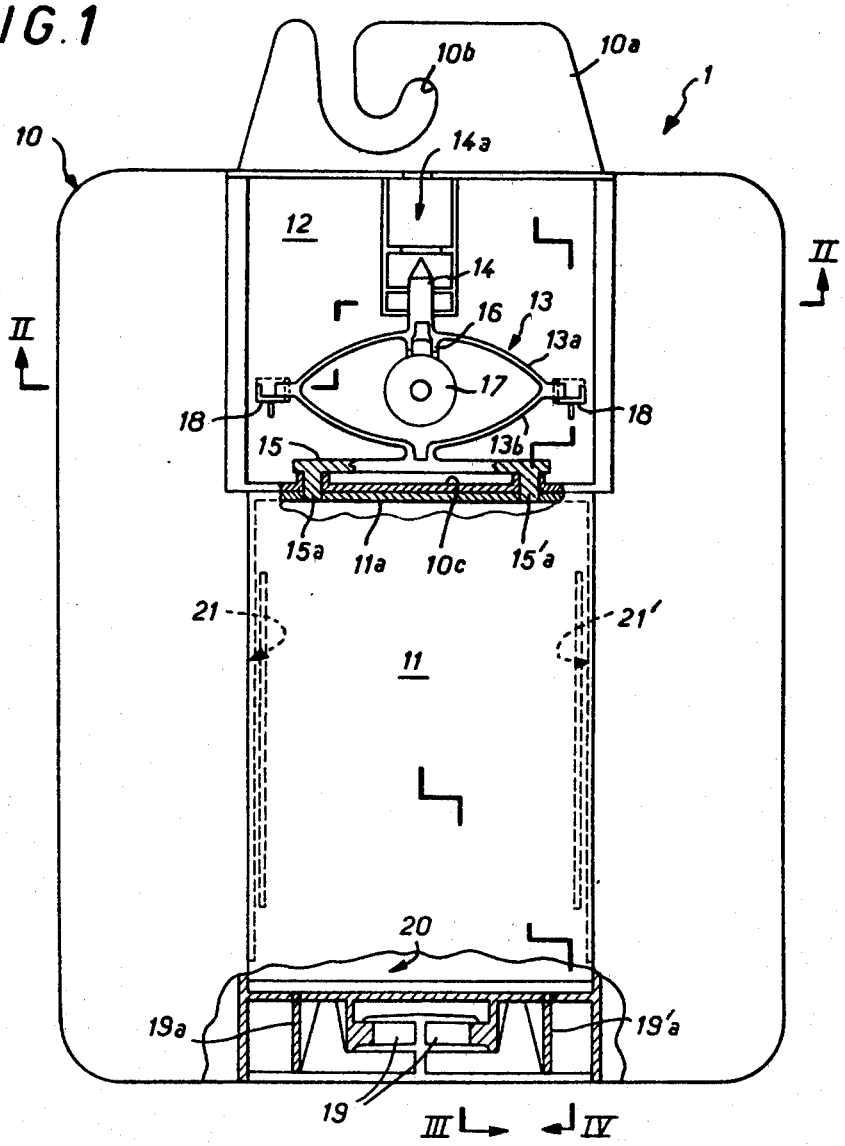
FIG. 1 is a general plan view of a package in accordance with the invention.
Figure 3:
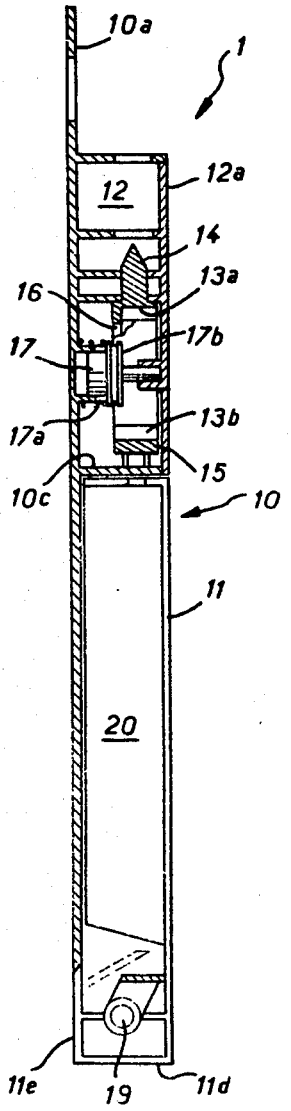
FIG. 3 is a cross-section on the plane III—III in FIG. 1.
Figure 4:
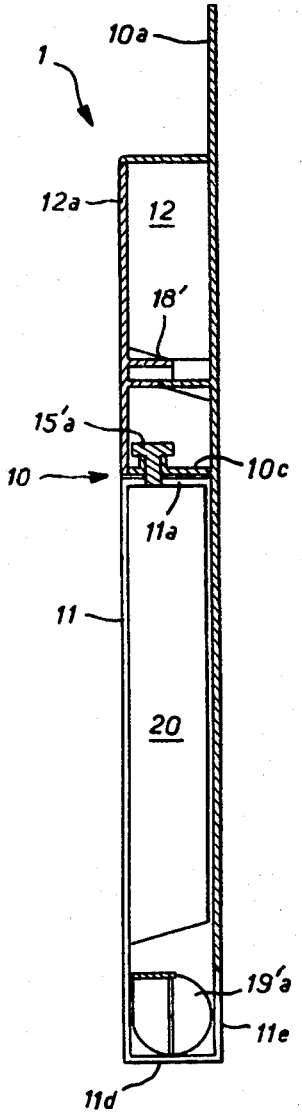
FIG. 4 is a cross-section on the plane IV—IV in FIG. 1.

In the selected embodiment shown in FIGS. 1 to 4, the package 1 generally comprises a baseplate 10 which is substantially rectangular with rounded corners and a trapezoidal extension 10*a*, stepped back relative to the plane of baseplate 10, centrally of one shorter side, with a hook-shaped opening 10*b* enabling package 1 to be suspended.

Molded into baseplate 10 are two parallelepiped-shaped depressions, namely a housing 20 for the article and a compartment 12 for the locking device, housing 20 and compartment 12 being separated by a wall 10*c*. A cover 11 hinged to baseplate 10 by a pivot pin 19 near the shorter side of the baseplate opposite extension 10*a* comprises raised edges 11*a*, 11*b* and 11*c* (FIG. 5) which are respectively positioned adjacent wall 10*c* and the two adjacent walls of housing 20 when cover 11 is folded down flush with baseplate 10.

Compartment 12 accommodates the locking mechanism of the package and is closed by a plate 12*a* ultrasonically welded to it and flush with baseplate 10. Compartment 12 contains a lock spring assembly 13 consisting of two arc members 13*a* and 13*b* with oppositely directed concavities and connected together at their ends, these ends being supported on two abutment members 18 and 18' integral with package 1. The first arc member 13*a* has at its top on the convex side a thrust member 14 disposed parallel to the longer axis of baseplate 10, opposite profiled opening 14*a* formed in the shorter side of baseplate 10, beneath attachment extension 10*a*. The second arc member 13*b* has on its top a crossmember 15 which supports two bolt members 15*a* and 15'*a* which extend through wall 10*c* and penetrate bolt-holes formed in raised edge 11*a*. Note that the ends of spring assembly 13 are in positive abutment when thrust member 14 is urged inwardly.

Within spring assembly 13 is disposed a fly-weight 17 of ferromagnetic metal having the general shape of a body of revolution and capable of moving along its axis perpendicular to baseplate 10 under the effect of a magnetic field which attracts it towards baseplate 10 and against the action of a spring 17*a* which maintains the fly-weight in the plane of spring assembly 13.

At the top of arc member 13*a*, on the concave side, is a projection 16 in line with a peripheral groove 17*b* machined into fly-weight 17.

The cover pivot pin 19 is disposed in a compartment in cover 11 comprising the front of the cover, a base 11*d* perpendicular to the general plane of cover 11, and a flange 11*e* parallel to this general plane. It is equidistant from these three wall members. Circular flanges 19*a* and 19'*a* coaxial with pivot pin 19 are tangential to the aforementioned three wall members 11, 11*d*, 11*e*. Thus the pivot assembly comprises two cooperating guides. The purpose of this arrangement will be described in more detail later.

Figure 5:
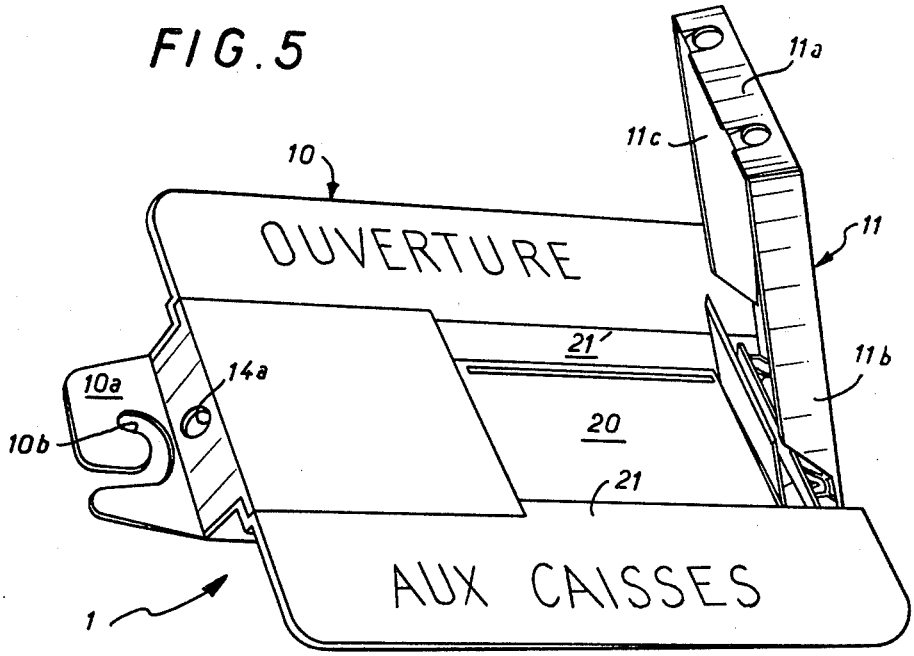
FIG. 5 is a perspective view of an open package.
Figure 6:
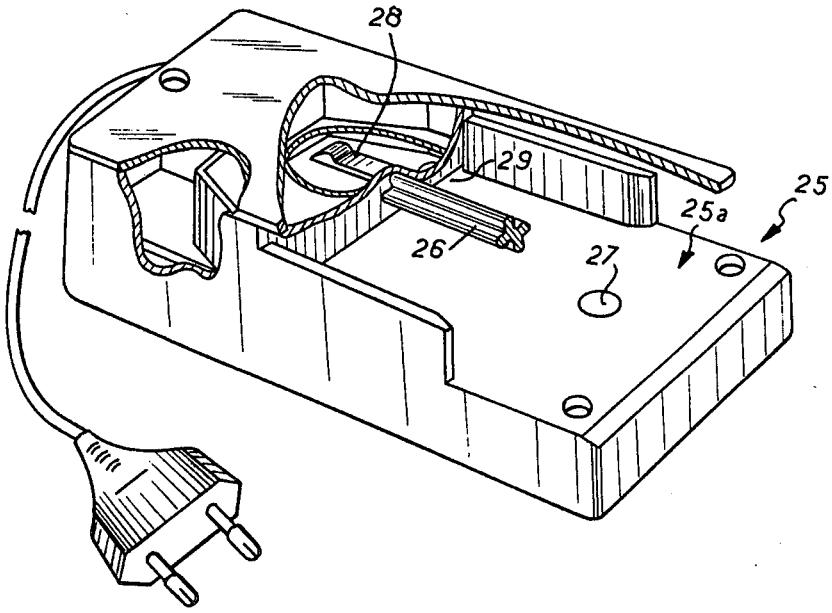
FIG. 6 is a partially cutaway perspective view of a key device for opening the package in accordance with the invention.

FIG. 5 is a perspective view of package 1 when open and will facilitate understanding of the opening operation, when taken in conjunction with FIG. 6 which is a general view of a key device 25.

In order to open it, the closed package 1 is offered up to key device 25 with the baseplate uppermost and flat on plate 25*a*, so that extension 10*a* enters slot 29. The cruciform rod 26 engages in opening 14*a* behind which is a diaphragm (no reference number) with a cruciform opening. Before rod 26 comes into contact with thrust member 14, extension 10*a* has operated the movable part of a switch 28 so as to energize a coil disposed in a ferromagnetic carcase, the core of which can be seen emerging at 27. Fly-weight 17 becomes magnetized in the magnetic field of the armature and retracts from in front of projection 16, compressing spring 13. As insertion of the package continues, rod 26 pushes back abutment member 14 and projection 16 passes over fly-weight 17. Arc member 13*a* is flattened, its ends supported on abutment members 18 and 18' moving apart, which results in flattening of arc member 13*b* and retraction of bolt members 15*a*, 15'*a*. Cover 11, which is slightly prestressed in the opening direction, may be opened to gain access to the article.

Note that the arrangements relating to cover 11 as a whole and housing 20 are such that a thin rigid member, such as a knife blade or safety razor blade, for example, inserted into the cracks between the cover and housing cannot reach the sensitive parts of the package. Bolt members 15*a*, 15'*a* are not formed with ramp surfaces for automatically closing the package, ramp surfaces instead being formed in recessed fashion in raised edge 11*a*, beneath the bolt members. Also, flanges 19*a*, 19'*a* which contribute to pivotal guiding of the cover also block access to pivot pin 19.

With regard to the closing of the package after the insertion of an article, note that the unilateral abutment of the ends of spring member 13 on abutment members 18, 18' enables bolt members 15*a*, 15'*a* to be drawn back without arc members 13*a*, 13*b* deforming symmetrically relative to the alignment of abutment members 18, 18', as the ends of the spring assembly move away from the abutment members.

In the embodiment described herein, all parts of the package except for the lock components are molded from colored transparent polycarbonate, in particular to render the article visible. It would not be commercially viable to offer the article for sale in such a way that it was not visible or clearly discernible.

Also, the package described is designed for the merchandizing of prerecorded magnetic tape cassettes and incorporates an article housing 20 adapted to the format of this article, whereas the baseplate measures approximately 21 by 17 centimeters, so that the package cannot be hidden in a normal pocket. It will be understood, however, that the dimensions of the housing and of the baseplate are respectively adaptable to conform to the article and to allow for such means as may be envisaged for hiding the package, according to the value of the article.

It will be understood that various changes in the details, materials and arrangements of parts, which have been herein described and illustrated in order to explain the nature of the invention, may be made by those skilled in the art within the principle and scope of the invention as expressed in the appended claims.

It is claimed:

1. A re-usable theft-resistant package suitable for self-service merchandizing of goods, comprising a cover, a lock adapted to be operated mechanically and electromagnetically and to retain said cover, a bolt member incorporated in said lock, a profiled opening in said package adapted to admit a complementarily profiled rod adapted to push back said bolt member and forming part of a corresponding key device, a fly-weight of ferromagnetic material disposed to resist selectively pushing back of said bolt member and adapted to permit pushing back of said bolt member by retracting in response to a magnetic field and a return spring adapted to resist retraction of said fly-weight, the arrangement being such that said fly-weight is retracted by a magnetic field produced by said key device to permit pushing back of said bolt member so as to unlock the package.

2. A package according to claim 1, wherein said bolt member comprises a spring assembly incorporating two arc members with oppositely directed concavities joined together at their respective ends, and further comprising abutment members integral with said package and adapted to support said ends of said arc members, a thrust member disposed at the top of a first arc member on its convex side, and a bolt support cross-member disposed at the top of the second arc member.

3. A package according to claim 2, wherein said fly-weight has the general shape of a body of revolution about an axis, is disposed between said arc members with said axis perpendicular to the plane defined by said arc members and comprises a peripheral groove, and said second arc member comprises a projection on its concave side in line with said thrust member and disposed opposite said peripheral groove, the arrangement being such that said ends of said arc members are positively abutted only when thrust is applied to said thrust member.

4. A package according to claim 1, further comprising a generally rectangular baseplate, a parallelepiped-shaped housing with a bottom and side walls formed in said baseplate, a compartment adapted to contain said lock molded into said baseplate and contiguous with said housing by virtue of a wall, and a plate adapted to close said compartment attached flush with said baseplate, said cover being adapted to complete said housing when disposed flush with said baseplate.

5. A package according to claim 4, wherein said cover incorporates raised edges adapted to fit inside and against said walls of said housing in the closed position of said cover.

6. A package according to claim 4, comprising a pivot pin on the side of said housing opposite the wall separating it from said lock compartment and whereby said cover is pivoted to said baseplate, and a compartment terminating said cover, containing said pivot pin and having a base perpendicular to the general plane of said cover and a flange adapted to be flush with said base of said housing in the closed position of said cover.

7. A package according to claim 6, wherein said pivot pin is disposed equidistantly from the general plane of said cover, from said base of said pivot pin compartment and from said flange of said pivot pin compartment, and further comprising circular flanges coaxial with said pivot pin and tangential to the three sides of said pivot pin compartment.

8. A package according to claim 1, wherein at least said cover is of a transparent plastics material.

9. A package according to claim 1, wherein said baseplate is provided with suspension means extending from one of its shorter sides.

10. A package according to claim 1, wherein said baseplate is at least 21 centimeters by 17 centimeters.

* * * * *